US006269493B2

(12) United States Patent
Sorensen

(10) Patent No.: US 6,269,493 B2
(45) **Date of Patent: *Aug. 7, 2001**

(54) BREAKAWAY DRAIN COVER

(76) Inventor: Edwin C. Sorensen, 725 25th St. N., Fargo, ND (US) 58102

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/417,156

(22) Filed: Oct. 12, 1999

(51) Int. Cl.[7] ..... E04H 4/06

(52) U.S. Cl. ..... 4/541.1; 4/504; 4/509; 417/33; 417/44.1

(58) Field of Search ..... 4/504, 507, 509, 4/541.1, 541.2; 417/33, 44.1

(56) References Cited

U.S. PATENT DOCUMENTS

| | | | |
|---|---|---|---|
| D. 333,342 | 2/1993 | Newhard | D23/261 |
| 2,926,360 | 3/1960 | Erickson et al. | 4/173 |
| 3,378,858 | 4/1968 | Jacuzzi | 4/172 |
| 3,940,807 | 3/1976 | Baker et al. | 4/172 |
| 4,115,878 | 9/1978 | Johnson et al. | 4/172.17 |
| 4,170,047 | 10/1979 | Corsette et al. | 4/293 |
| 4,402,094 | 9/1983 | Sanders | 4/504 |
| 4,620,835 | 11/1986 | Bell | 417/17 |
| 4,658,449 | 4/1987 | Martin | 4/496 |
| 4,676,894 | 6/1987 | Diamond et al. | 210/167 |
| 4,716,605 | 1/1988 | Shepherd et al. | 5/544 |
| 5,167,041 | 12/1992 | Burkitt, III | 4/541.2 |
| 5,408,706 * | 4/1995 | Barnes | 4/507 |
| 5,690,476 * | 11/1997 | Miller | 4/504 |
| 5,725,359 * | 3/1998 | Dongo et al. | 4/509 |
| 5,809,587 * | 9/1998 | Fleischer | 4/504 |
| 5,983,416 * | 11/1999 | Idland | 4/509 |

FOREIGN PATENT DOCUMENTS

| | | |
|---|---|---|
| 4010862 | 4/1991 | (DE) . |
| 58-12945 | 1/1983 | (JP) . |
| 435706 | 2/1992 | (JP) . |

* cited by examiner

*Primary Examiner*—Charles R. Eloshway
(74) *Attorney, Agent, or Firm*—Curtis V. Harr

(57) ABSTRACT

A spa system which emp loys a removable drain cover. Removal of the drain cover will cause a proximity switch to turn off the circulation pump in the spa. In a preferred embodiment, the removable drain cover has a magnet attached to it and a magnetically actuable reed switch is attached to the drain body in proximity to the drain cover. Removal of the drain cover with the magnet attached will cause the reed switch to change state which opens a circuit controlling the operation of the spa pump thereby shutting down the spa circulation system. As a result, the spa circulation system cannot be operated without the drain cover in place. This reduces the likelihood of unwanted objects being drawn into the drain. Furthermore, should the spa user's hair become entangled in the drain cover or the drain pipe, the spa pump may be turned off by simply removing the drain cover thereby permitting the entangled user to be released.

16 Claims, 2 Drawing Sheets

FIG 2
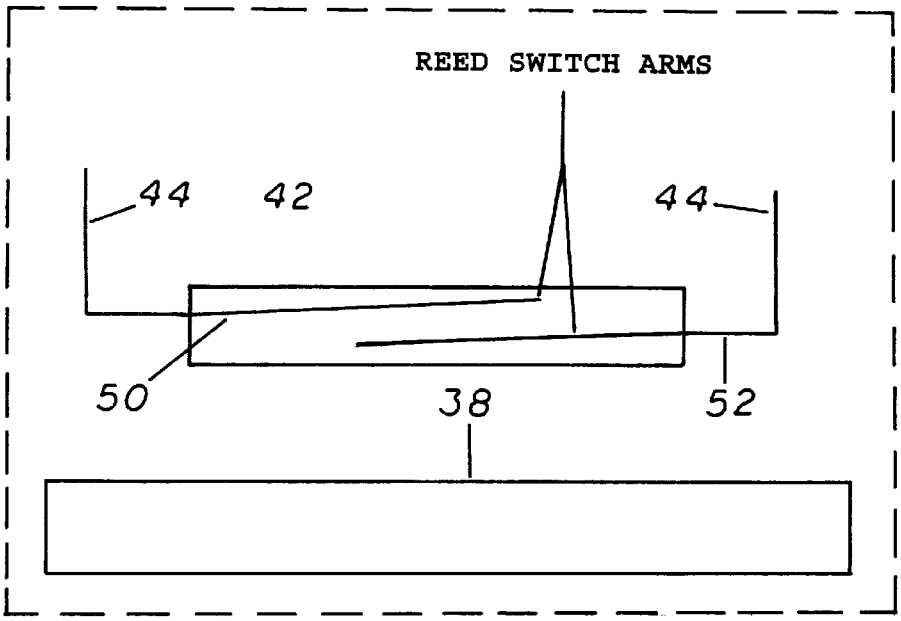
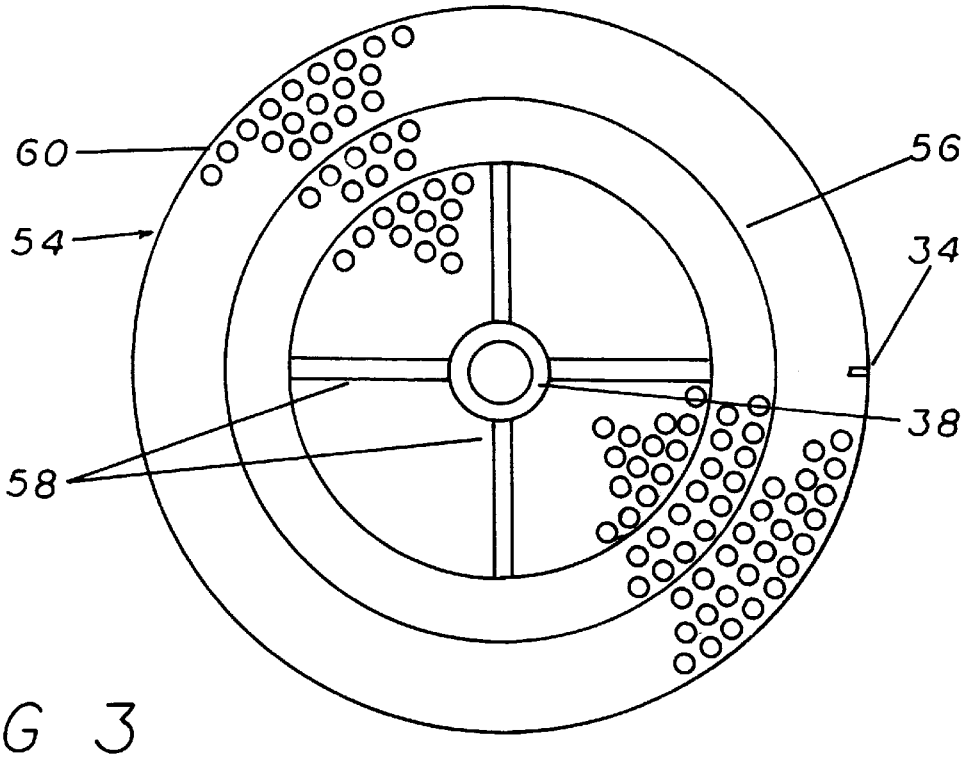
FIG 3

BREAKAWAY DRAIN COVER

BACKGROUND OF THE INVENTION

The present invention relates to liquid circulation systems, and more particularly to a system and method for automatically turning off a spa circulation system in certain situations.

Spas, also known as hot tubs, whirlpools, etc., utilize relatively powerful pump driven circulation systems to inject powerful streams of water into the spa. This water stream, often combined with air, is directed onto the user, thereby creating a pleasing, sometimes therapeutic effect. The circulation system providing such water streams draws water from the spa itself through a drain typically located at the bottom or wall of the spa. Because of the relatively high volume of water required to produce the desired pressure in the resulting water streams, (typically in the range of 50–100 gallons per minute) water is drawn by the circulation system through the drain opening at a relatively high velocity.

To ensure that foreign objects are not drawn into the drain, a drain cover is usually employed having small holes to permit only water to enter the circulation system. Operation of the spa without the drain cover in place could create a number of potential problems. For example, foreign objects brought into the circulation system could damage the pump or other components in the circulation system. Moreover, because of the relatively high velocity of the water drawn into the drain, there is a possibility of users of the spa having limbs or hair drawn into the drain.

Nevertheless, it has been found that users of spas sometimes remove the drain covers for cleaning and may neglect to replace the cover and operate the spa without the cover in place. To prevent this from occurring, spas in the United States generally comply with the Consumer Product Services, Underwriter Laboratory (UL) or American National Standards Institute (ANSI) requirements that a spa drain cover be removable only with the use of tools. For example, the drain cover may be secured by one or more screws. It is felt that this requirement lessons the likelihood that a spa will be used without the drain cover in place. For example, with this requirement it is less likely that children playing in the spa would remove the drain cover during use.

Yet even with the requirement that spa drain covers be secured in this manner, it is still possible for a user to fail to replace the drain cover and to operate the drain without the cover in place. This could result in the aforementioned problems. Furthermore, it has been found that even with the drain covers in place, it is unlikely but possible for a person's hair to be drawn into the drain. Once this occurs, the hair may be difficult to remove due to the relatively strong suction force in the drain opening, and also due to the possibility that they hair may become entangled in the drain cover openings. Once the person's hair is entangled in the drain cover, drain covers requiring tools to remove make the situation worse since the person will not normally have an opportunity to obtain a tool to remove the drain cover. Additionally, spa drain openings often employ an anti-vortex structure near the drain cover which provides an additional way for hair to become entangled.

Thus while hazards still exist with drain covers that require tools to remove, it is generally felt (and in fact required) that drain covers be secured in this way because the risk of user entrapment is lower than it would be if drain covers were easily removed.

A further problem which stems from the above discussed situation, is that the flow rate in spas is frequently limited (for example, to 50 gallons per minute) to thereby reduce the suction force in any effort to make spas safer. As a result of limited flow rates, the water pressure producing the water jets to provide recreational and therapeutic benefits is necessarily limited.

Thus, it would be desirable to provide a spa which further reduces or eliminates the possibility of a person's hair becoming entrapped in the spa drain. It would also be desirable to provide a spa drain cover which reduces the possibility of hair entrapment in the spa drain. It would also be desirable to provide a spa which reduces such risks to the user whether the drain cover is in place or not. Furthermore, it would be desirable to provide a spa which can safely utilize a higher flow rate than is currently used.

SUMMARY OF THE INVENTION

Pursuant to the present invention, a circulation system for a spa, swimming pool or jetted tub is provided which automatically shuts off in the event that drain cover is removed. In particular, the system includes a spa shell which contains a liquid and a circulation pathway which permits the liquid to flow from the spa shell at a drain outlet and back into the spa shell through an inlet. A pump is coupled to the circulation pathway which forces liquid through the circulation pathway. A drain cover which has a plurality of openings is removable and attached to the drain outlet in the spa. A switch is coupled to the drain cover and also to the pump for deactivating the pump upon removal of the drain cover. Thus, the pump will not operate without the drain cover in place. As a result, a removable drain cover may be utilized with the risk of operating the pump without the drain cover in place. Also, in the event that a person's hair is entangled in the drain cover, the person may be easily released by simply removing the drain cover and thereby shutting off the pump. This invention also permits the safe use of higher flow rates in spas then would otherwise be recommended.

DESCRIPTION OF THE DRAWINGS

The various advantages of the present invention will become apparent to one skilled in the art by reading the following specifications and by reference to the following drawings in which:

FIG. 2 is a diagram of the proximity switch used in accordance with a preferred embodiment of the present invention.

FIG. 3 is a bottom view of a drain cover in accordance with another embodiment of the present invention incorporating an anti-vortex device.

DESCRIPTION OF THE PREFERRED EMBODIMENT

Figure 1:
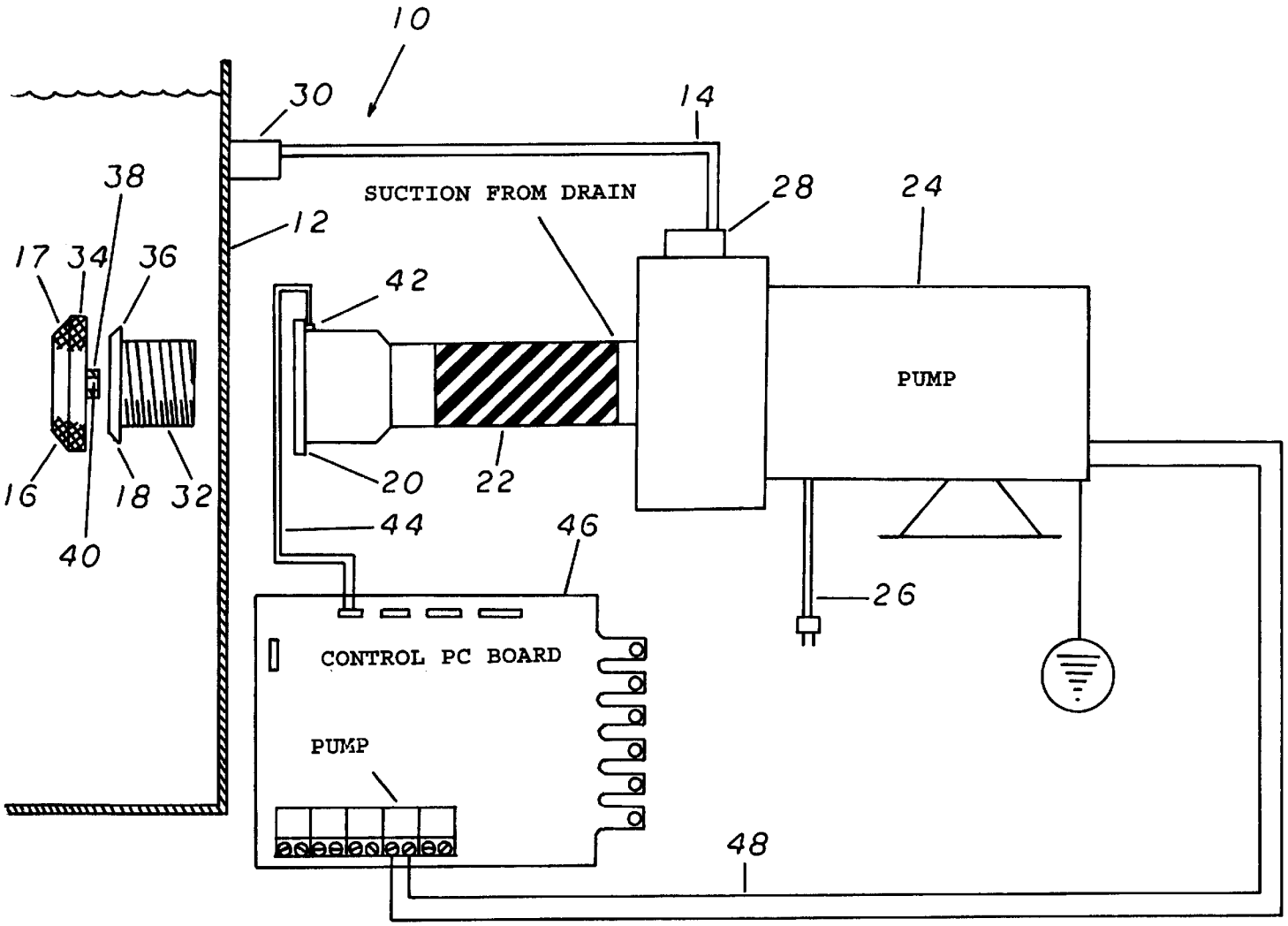
FIG. 1 is a diagrammatic representation of the spa in accordance with the present invention.

Referring now to FIG. 1 there is shown a spa 10 incorporating the breakaway drain cover of the present invention. The spa 10 includes a shell 12 which is shown partially in cross section in FIG. 1. The shell 12 will contain water and is preferably composed of molded fiberglass. A water circulation system 14 provides for circulation of water from the interior of the spa shell 12 and back out into the spa creating the desired high pressure water jets. A conventional filtration system (not shown) is also integrated into the water circulation system.

In more detail, the water circulation system 14 includes a drain comprising a drain cover 16, a drain wall fitting 18, a drain body 20, and a return drain pipe 22 which transfers water from the interior of the spa shell 12 to a pump 24. Pump 24 comprises a typical spa pump which is powered through an external source of electrical power received through electrical line 26. Pump 24 drives water from the drain pipe 22 out to the water return pipe 28. The return pipe 28 then carries water to one or more spa jets 30 which generates a high velocity water stream into the spa shell 12 interior. Spa jet 30 may compromise, for example, a spa jet which provides for an adjustable flow rate direction which also mixes an adjustable quantity of air with the water stream. Such a spa jet is described, for example, in U.S. patent application Ser. No. 08/147,171, entitled "Combination Adjustable Jet Value " which is assigned to Dimension One Spas of Oceanside, Calif.

Drain wall fitting 18 is inserted into an opening (not shown) in the spa shell 12 and is threaded into the drain body 20 by means of threads 32. Drain cover 16 is attached to drain wall fitting 18 by means of a snap fit so that drain cover 16 may be easily attached and removed by hand without the use of tools. For example, in the preferred embodiment this snap fit may be achieved by means of detent 34 which snaps into a notch 36 in the drain wall fitting 18. Alternatively, a raised ring on the drain body engages with a tang on the drain cover.

Drain cover 16 has a plurality of holes 17 to permit water to flow through the drain cover and enter the drain body 20.

Drain cover 16 also includes a magnet 38 which is mounted onto a post 40 attached to the drain cover 16 at its central axis. Magnet 38 is designed to interact with reed switch 42 which is mounted at the side of the drain body 20. Reed switch 42 is connected by means of wires 44 to a control PC board 46. Control PC board 46 comprises a conventional spa control PC board such as will be familiar with those skilled in the art. Control PC board 46 has an output connected to wires 48 are connected to the pump 24. Reed switch 42 is a normally open switch which manipulates an I/O pin on PC Board 46 in order to connect or disconnect the two wires 48 to enable and disable the operation of the pump 24. In the preferred embodiment, the reed switch 42 controls an interlock protection relay (not shown) in the control PC board 46. In this way, when drain cover 16 is attached to the drain wall fitting 18, magnets 38 cause the reed switch 42 to close thereby completing a circuit for the pump 24 permitting the pump to operate.

Further details of the operation of the reed switch 42 are shown in FIG. 2. Reed switch 42 composes a pair of reed arms 50 and 52. Reed 50 comprises a flexible strip of conductive material mounted in such a way as to permit up and down motion in the orientation shown in FIG. 2. Reed 52 is likewise conductive of a strip of conductive material but is mounted in a fixed manner to the reed switch 42. When magnet 38 is brought within proximity of reed switch 42 the magnetic force of attraction pulls reed 50 toward magnet 38 thereby causing it to make contact with reed 52. The exact proximity required by magnet 38 to move reed 50 to make contact with reed 52, will depend on the reed switch used and the strength of the magnet 38. For example, reed switch 42 may comprise a reed switch model number MDSR-4-17-23 available from Hamlin Corporation of Lake Mills, Wis.

It will be appreciated that a variety of types of switches or sensors may be used in other embodiments of the present invention besides reed switch 42. For example, these include but are not limited to: proximity switches, mechanical switches, optical switches, and other types of switches or sensors capable of detection of the removal of the drain cover.

Referring now to FIG. 3 and additional embodiment of a drain cover in accordance with the present invention is shown. Drain cover 54 in this embodiment includes an anti-vortex device 56. Drain cover 54 includes a series of holes 60 to permit water to flow through. Also, the detent 34 is shown in drain cover 54. It will be appreciated by those skilled in the art that in anti-vortex device prevents the creation of vortex in the water as it is drawn into the drain body 20. It does this by means of a series of fins 58 which resist circular motion of water which creates a vortex. It will be appreciated that anti-vortex devices in spas are frequently affixed to the drain body 20. However, this location of the anti-vortex device raises the possibility of entanglement of hair even in the case where the drain cover 16 has been removed and the pump is shut off. Thus, it is much preferable in accordance with this invention to have the anti-vortex device 56 attached to the drain cover 54 to prevent this from occurring. In this embodiment, should a person's hair become entangled in the anti-vortex device 56, the drain cover containing the anti-vortex device is easily removed from the water along with the entangled hair.

As a result, pump 24 in spa 10 will only be operational when the drain cover 16 is in place. This reduces the likelihood that objects or a person's hair will become drawn into the drain body 20 since the pump cannot operate without the drain cover on. When the drain cover is on, and the pump is operational, there is still a possibility of a person's hair being drawn into the drain body through openings in the drain cover. However, should this occur, the easily removable drain cover can be removed thereby disabling the pump and allowing the person to be released. Thus, two of the features of the present invention reduce the possibility of a person becoming entrapped by hair drawn into the drain body. First, simply by virtue of having the drain cover easily removable, hair which may be entangled in the drain cover can be freed by removing the drain cover itself. Second, the process of removing the drain cover will free hair which may be drawn into the drain pipe with a significant amount of force. For example, it is conceivable that in some situations, simply removing the drain cover would not permit the hair to become free because of the suction created in the drain pipe by the pump 24. Thus, Applicant's invention shuts down the pump and provides a second safety measure to permit the user to escape.

It will be appreciated that the water circulation system 14 utilizing the breakaway drain cover of the present invention may be utilized in a variety of applications beside spas, such as swimming pools and jetted tubs. Also, the circulation system 14 may be built into a new spa or may be added to an existing spa by means of retrofit application.

Those skilled in the art can appreciate that other advantages can be obtained from the use of this invention and that modification may be made without departing from the true spirit of the invention after studying the specifications, drawings and following claims.

What is claimed is:

1. A liquid circulation system coupled to a liquid containing vessel comprising:

a vessel shell containing a liquid, said vessel shell including outlet and inlet openings;

a circulation pathway for permitting said liquid to flow from said outlet opening and back into said inlet opening;

a pump coupled to said circulation pathway, said pump forcing the liquid through said circulation pathway;

a drain cover having a plurality of openings, removably attached to said inlet opening; and a switch coupled to said drain cover and also to said pump for deactivating said pump upon the removal of said drain cover, whereby said pump will not operate without said drain cover in place.

2. The system of claim 1 wherein said switch comprises a magnet attached to said drain cover and a magnetically actuated switch member disposed at said drain outlet within proximity to said magnet, wherein the removal of said drain cover results in movement of said switch member, thereby changing the state of said switch member to deactivate said pump.

3. The system of claim 2 wherein said switch comprises a reed switch.

4. The system of claim 1 further comprising a control unit coupled between said switch and said pump for sensing a change in the state of said switch upon the removal of said drain cover and transmitting a signal to said pump causing the deactivation of said pump.

5. The system of claim 1 wherein said drain cover physically engages with said drain inlet in a manner which removably secures the drain cover to the drain inlet but which permits the removal of said drain cover by hand without tools.

6. The system of claim 5 wherein said drain cover further comprises a detent which engages with a groove in said drain inlet to removably secure the drain cover to the vessel shell.

7. The system of claim 1 wherein said drain cover further comprises an anti-vortex structure.

8. The system of claim 1 wherein said vessel is a spa.

9. The system of claim 1 wherein said vessel is a swimming pool.

10. In a spa having a spa shell containing a liquid, a pump and circulation pathway for pumping said liquid from said spa shell at an outlet opening and back into said spa shell through an inlet opening, the improvement comprising:

a drain cover removably attached to said outlet opening;

a switch attached to said drain cover and said outlet opening for sensing when said drain cover is removed, said switch being coupled to said pump so as to activate said pump when said drain cover is attached to said outlet opening and deactivate said pump when said drain cover is not attached to said outlet opening.

11. The spa of claim 10 wherein said switch comprises a magnet attached to said drain cover and a magnetically actuated switch member disposed at said outlet opening within proximity to said magnet, wherein the removal of said drain cover results in movement of said switch member, thereby changing the state of said switch to deactivate said pump.

12. The spa of claim 11 wherein said magnetically actuated switch member comprises a reed switch.

13. The spa of claim 10 further comprising a control unit coupled between said switch and said pump for sensing a change in the state of said switch upon the removal of said drain cover and transmitting a signal to said pump causing the deactivation of pump.

14. The spa of claim 10 wherein said drain cover physically engages with said outlet opening in a manner which removably secures the drain cover to the outlet opening but which permits the removal of said drain cover by hand without tools.

15. The spa of claim 14 wherein said cover further comprises a detent which engages with a groove in said outlet opening to removably secure the drain cover to the spa shell.

16. A method for disabling a pump driven liquid circulation system in a liquid containing vessel, said method comprising the steps of:

locating a removable drain cover in said vessel;

locating a switch on said vessel with a portion of said switch on said drain cover;

actuating said switch upon the removal of said drain cover from said vessel; and disabling the circulation system pump by cutting power to said pump upon said actuation of said switch, whereby said spa circulation system is disabled whenever the drain cover is removed.

* * * * *